United States Patent [19]

Lanuza

[11] Patent Number: 4,986,332

[45] Date of Patent: Jan. 22, 1991

[54] FASTENING TRACK ASSEMBLY FOR FABRIC WALLCOVERINGS

[75] Inventor: Craig S. Lanuza, 2192 Channel Dr., Ventura, Calif. 93001

[73] Assignee: Craig S. Lanuza, Ventura, Calif.

[21] Appl. No.: 565,247

[22] Filed: Aug. 9, 1990

[51] Int. Cl.[5] ..... E06B 9/56

[52] U.S. Cl. ..... 160/327; 52/716; 52/222; 24/543

[58] Field of Search ..... 160/327, 328; 24/543, 24/530; 52/716, 222, 273

[56] References Cited

U.S. PATENT DOCUMENTS

| | | | |
|---|---|---|---|
| 1,171,952 | 10/1916 | Higgin . | |
| 1,588,161 | 8/1926 | Bost . | |
| 3,822,734 | 7/1974 | Tombu | 160/327 X |
| 3,848,380 | 11/1974 | Assael . | |
| 3,928,897 | 12/1975 | Tombu . | |
| 3,982,307 | 9/1976 | Smith et al. | 24/543 |
| 4,018,260 | 4/1977 | Baslow . | |
| 4,053,008 | 10/1977 | Baslow . | |
| 4,231,141 | 11/1980 | Derrick et al. . | |
| 4,403,642 | 9/1983 | Morris . | |
| 4,625,490 | 12/1986 | Baslow | 160/327 X |
| 4,817,699 | 4/1989 | Fein | 160/327 |
| 4,835,824 | 6/1989 | Durham et al. | 24/543 X |

*Primary Examiner*—Blair M. Johnson

[57] ABSTRACT

An assembly comprising of first, second and third tracks of extruded polyvinyl chloride plastic which, when intermeshed create a framework for stretching and securing fabrics of varying thicknesses, onto a wall surface, a first extruded track is fastened to the wall surface with screws, a second or third extruded track is snapped into the first track creating a set of working jaws and a fabric storage slot, a sheet of fabric is then stretched around the wall perimeter, with the excess fabric being tucked and secured through the working jaws and into the fabric storage slot. Fabric installation options and overall strength of the framework are greatly increased through the flexibility and staggering of the track assemblies and their ability to facilitate and slide upon each other on extreme curves, therefore increasing the overall versatility of the present invention.

3 Claims, 4 Drawing Sheets

FASTENING TRACK ASSEMBLY FOR FABRIC WALLCOVERINGS

BACKGROUND

1. Field of Invention

This invention relates generally to fabric wallcoverings and more specifically to a fastening track assembly attachable to a wall or flat surface to create a bordered framework on which fabric may be stretched and secured to cover the surface of a wall without the need to prepare the surface or to apply the fabric directly to the surface.

2. Description of Prior Art

It is known to provide a framework formed of plastic supporting channels fastened to border areas of interior walls by means of staples, screws, nails or other fasteners, fabric is then stretched and secured from all sides by various methods, thereby providing a naturally smooth finish.

More recently for the purpose of covering an interior wall with an attractive textile fabric, paper-backed fabrics have been produced to be applied to the surface of a wall in the same method as wallpaper. Paper-backed fabrics suffer from the same problems as conventional wallpapers, paints, and other wallcoverings, before these methods can be applied to the wall, it is usally necessary to prepare the surface, to strip the wall of old wallpaper, to repair cracks, holes, and any other imperfections which may prevent a smooth unbroken surface, any defects in the underlying wall surface would be reflected in the face and texture of the fabric adhered thereto.

Thereafter, inventors created several types of border pieces for providing a fabric supporting framework used in the hanging and stretching of fabric wallcoverings, without the need to prepare the surface or to adhere the fabric directly to the surface.

U.S. Pat. No. 4,018,260 to Baslow (1977) discloses a one piece plastic channel which is buttered end to end to form a framework around surface to be covered, fabric is then stretched on frame with excess salvage stuffed into channel; however, due to its one piece design and installation process, it is necessary to fasten the plastic channel at the inside edge, furthest away from the channel inlet which holds the fabric, thus if caution is not exercised when stretching and stuffing fabric, channel will flex, resulting in a weaker framework.

As time progresses it may be desired to change fabrics, due to time and wear it may also be necessary to replace plastic channels if they have lost there ability to hold fabrics, therefore a one piece design would require complete removal of framework from the wall surface, consequently new channels and fasteners must be installed.

Another significant drawback of the one piece channel wallcovering system, is its end to end alignment and strength at the seams, application of a one piece channel does not offer the ability to stagger front and back piece seams for increased strength and exact track alignment.

U.S. Pat. No. 4,403,642 to Morris (1983) describes a two piece fabric supporting system, which claims to minimize fabric installation time, without the need of special tools for stuffing the fabric in any type of resilient slot. The two piece system described in this patent is designed to work with a hinge action, whereby when two pieces are swung together, fabric is stretched and locked into place; however, there are some disadvantages to this method.

When covering a wall which has either windows or doors a paneled method must be used, this process requires breaking down into sections all areas above, below, and to the sides of windows and doors, these sections are then covered as separate panels, consequently many more border pieces must be used, increasing installation time, thus resulting in a greater expense.

U.S. Pat. Nos. 4,018,260; 4,053,008; 4,403,642 and 3,928,897 are all concerned with improved border pieces or channel assemblies for the installation of a fabric supporting framework. The framework assebmlies disclosed in these patents are such as to allow for the do-it-yourselfer to install a sheet of fabric thereto by means of simple tools, thus the need for professionally trained installers and the expense associated are removed.

OBJECTS AND ADVANTAGES

In view of the foregoing, it is the main objective of this invention to further improve upon border pieces or channels presently available, which are attachable to a wall to create a framework for hanging and stretching fabric thereto, primarily in that there are several fabric installation methods which can be applied, an increased strength due to fastener and track positioning, and an overall more versatile track assembly, allowing for added application options with superior results.

A significant feature of the present invention is a two piece fastening track assembly, designed with intermeshing external fingers to facilitate an opposing track. More particularly the fastening track assembly of the present invention includes, a first track of extruded plastic, comprised of four external fingers which protrude outward from wall surface, first track is secured by means provided to perimeter of surface to be covered. A second track of extruded plastic is provided, with three external fingers on one side, backed by a smooth face on the opposite side. An engagement of the bottom finger on the second track to opposing bottom fingers on the first track create a swinging ability for the second track, as the two pieces are pressed together the center fingers of the first and second tracks intermesh creating a positive locking catch, simultaneously the first and second track top fingers connect forming a set of working jaws.

With the foregoing in mine, there are several distinct features of the invention when pertaining to its strength. First, due to a two piece assembly it is possible to secure the first track to the wall surface from the inside, nearest the point where maximum tension is applied. Second, the two piece assembly allows for the staggering of seams, whereby the second track will overlap the first track seams and vice versa, thus increasing overall strength. Due to this overlapping method, alignment of the second track to first track is automatic.

Another objective of this invention is to have greater advantages over those methods which are directly applied onto the wall surface, whereby, if redecorating is desired fabrics can be easily removed and replaced. Therefore, it may be necessary to replace faulty track assemblies due to damage, repeated fabric changes, or loss of fabric holding capabilites. With this in mind, these objectives are rapidly accomplished by means of a removable second track, without the need to unfasten or refasten to the wall surface, thus reducing the time and materials needed.

In recent years advancements in architecture and building construction have progressed considerably, it is not uncommon to find round rooms, curved walls, slight to extreme curvatures, or even columns and pillars inside of buildings, therefore, a primary advantage of this invention lies in its ability to conform to the curvatures of these described walls, this is accomplished through the flexibility of both first and second track assemblies, and their ability to facilitate and slide upon each other on extreme curves.

DRAWING FIGURES

A better understanding of this invention as well as further objects and advantages will be gathered by referring to these accompanied drawings, wherein.

Reference Numerals in Drawings

Figure 1:
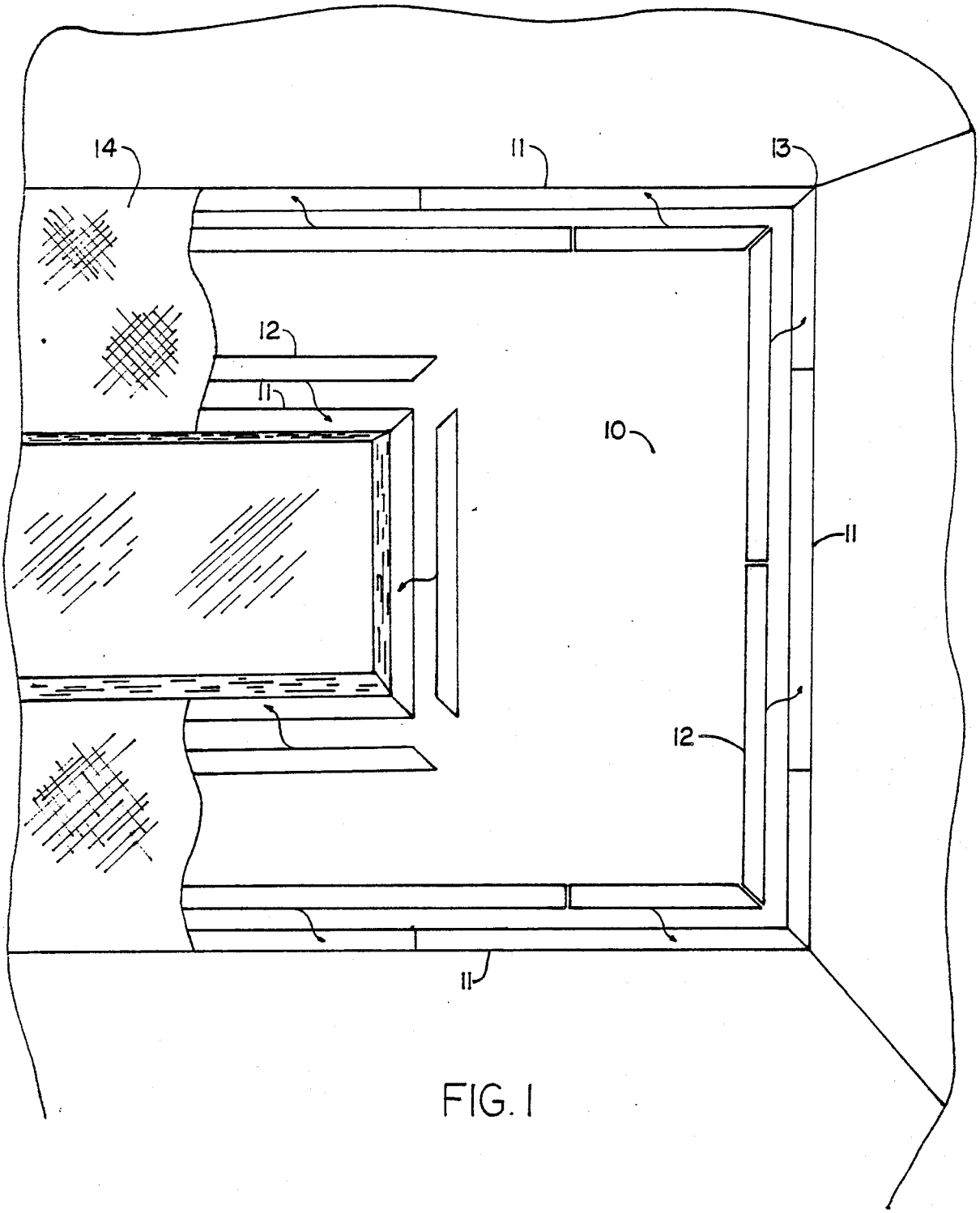
FIG. 1 is a fragmentary view of an interior wall which is covered with fabric utilizing the fabric supporting system of the present invention.

10 wall surface
11 first track
12 second track
13 45 degree corner cut
14 fabric
15 two-way adhesive
16 longitudinal grooves
17 angled finger
18 alignment groove
19 longitudinal barb
20 slightly curved barb
21 longitudinal finger
22 longitudinal arm
23 second longitudinal barb
24 mating barb
25 fastening screw
26 fastening screw
27 positive locking slot
28 fabric storage slot
29 curved arm
30 third track
31 mating grooves
32 flat longitudinal side
33 concaved notch
34 first set of working jaws
35 second set of working jaws
36 flat longitudinal face
37 positive locking catch
38 tucking tool

DESCRIPTION OF INVENTION

Referring now to FIG. 1, there is illustrated the interior wall 10 of a room to be covered with fabric utilizing the present invention. The fabric fastening track assembly of this invention includes a first track 11 and second track 12 mounted horizontally and vertically around perimeter of wall surface, doors and windows of the wall to be covered with fabric. At the related corners where the horizontal and vertical tracks meet, the corner end of track assemblies 11 and 12 are mitered at 45 degrees as indicated at 13. In FIG. 1, there is illustrated a cut away sheet of fabric 14 supported by the fabric fastening track assembly framework.

Figure 2:
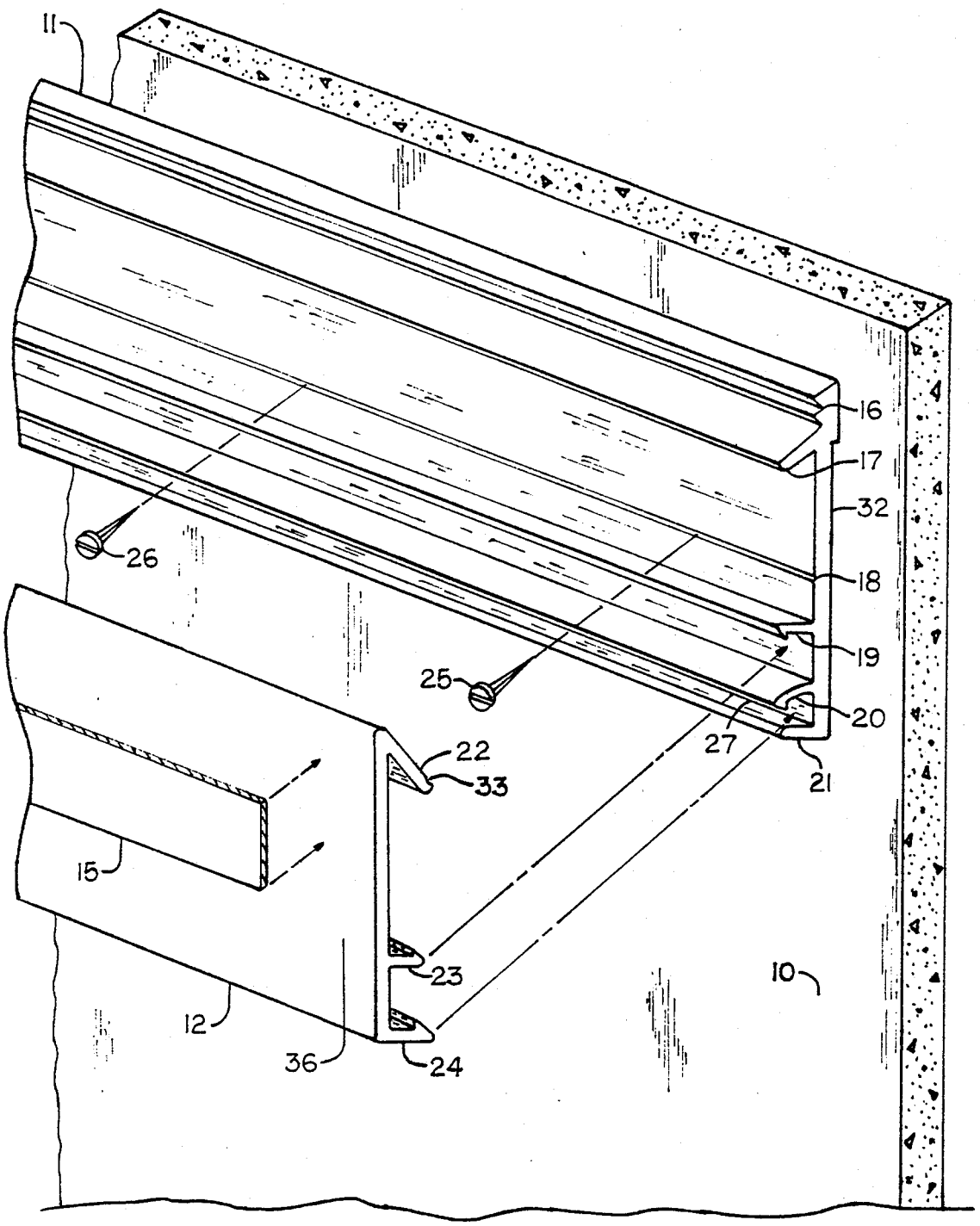
FIG. 2 is an exploded view of the fabric supporting border pieces used in forming the framework.

Referring now to FIG. 2, there is illustrated an exploded view of the horizontal and vertical track assemblies as described in FIG. 1, these track assemblies include a first track 11 and second track 12 made of extruded polyvinyl chloride plastic which allows for proper elasticity of operation.

Track 11 has a flat longitudinal side 32 for contact with a flat wall surface 10 to be covered with fabric, a set of longitudinal grooves 16 are positioned at the top or outermost edge of track 11, these grooves represent the first half of a second set of working jaws, beneath these grooves 16 is a longitudinal angled finger 17 facing outward from the wall surface 10, this longitudinal angled finger 17 represents the first half of a first set of working jaws.

Referring to track 11, located in the mid position is a longitudinal alignment groove 18, this alignment groove 18 is used for longitudinal positioning of fastening screws 25 and 26.

The opposite or innermost edge of the first track 11 is comprised of a longitudinal finger 21 facing outward from the wall surface 10, a longitudinal slightly curved barb 20 is positioned above the longitudinal finger 21 to define a positive locking slot 27.

Referring again to track 11, a longitudinal barb 19 is illustrated, positioned between alignment groove 18 and slightly curved barb 20 this longitudinal barb 19 defines the first half of a positive locking catch.

Referring again to FIG. 2, there is shown a second extruded track 12 having a flat longitudinal face 36 for direct contact with fabric.

One longitudinal edge of the second track having a downward angled longitudinal arm 22 with a concaved notch 33 on top of the outermost tip, the longitudinal arm 22 and concaved notch 33 are positioned in realtionship to contact angled finger 17 of first track 11, this longitudinal arm 22 and concaved notch 33 represent the second half of a first set of working jaws.

The opposite longitudinal edge of the second track having a male mating barb 24 positioned in relationship to intermesh into the positive locking slot 27 of track 11.

Referring again to track 12, a second longitudinal barb 23 is located in relationship to the longitudinal barb 19 of track 11, this second longitudinal barb 23 represents the second half of a positive locking catch.

A longitudinally placed two-way adhesive 15 is located on the flat longitudinal face 36 of track 12, this two-way adhesive 15 is used for the temporary securing and alignment of fabric.

A typical embodiment of the present invention and their ability to facilitate each other will be more evident by referring to FIGS. 3, 4, 5, and 6.

Figure 3:
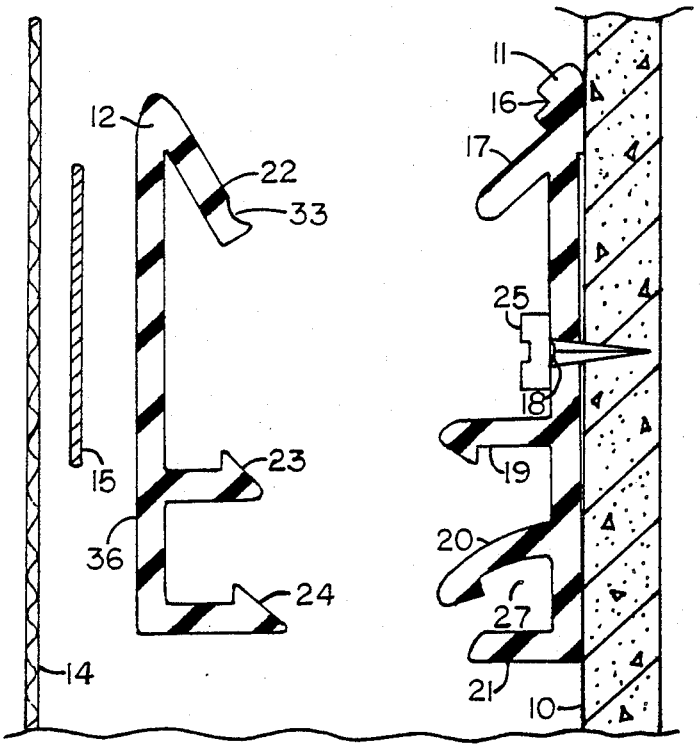
FIG. 3 is a side view of fabric supporting border pieces prior to intermeshing.
Figure 4:
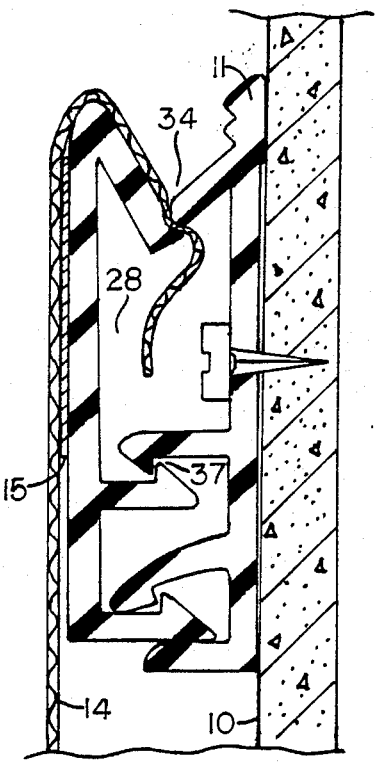
FIG. 4 is the same side view as FIG. 3 illustrating the fabric border pieces in their snapped together position.

Referring now to FIG. 3, the present embodiment is illustrated in a pre-snapped together position. Track 11 is secured to wall surface 10 with fastening screws 25, utilizing the longitudinal alignment groove 18. The second track 12 is then pressed into track 11 intermeshing the male mating barb 24 into the positive locking slot 27, simultaneously the longitudinal barb 19 and the second longitudinal barb 23 intermesh creating a positive locking catch as illustrated in FIG. 4 37, the downward angled longitudinal arm 22 with the concaved notch 33 contacts the longitudinal angled finger 17 creating a first set of working jaws as illustrated in FIG. 4 34 for securing fabric into the fabric storage slot FIG. 4 28.

Figure 5:
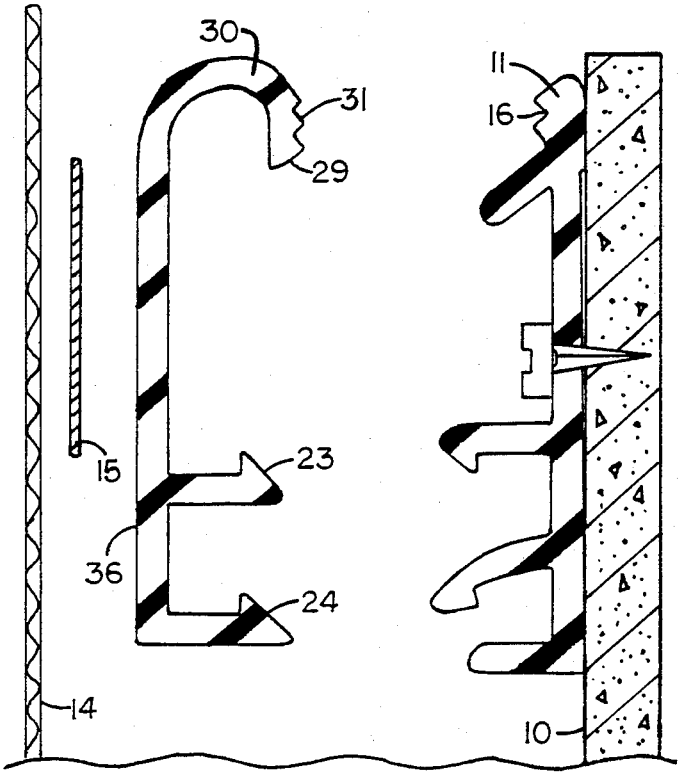
FIG. 5 is a similar side view as FIG. 3 showing an alternate front fabric supporting track prior to intermeshing.
Figure 6:
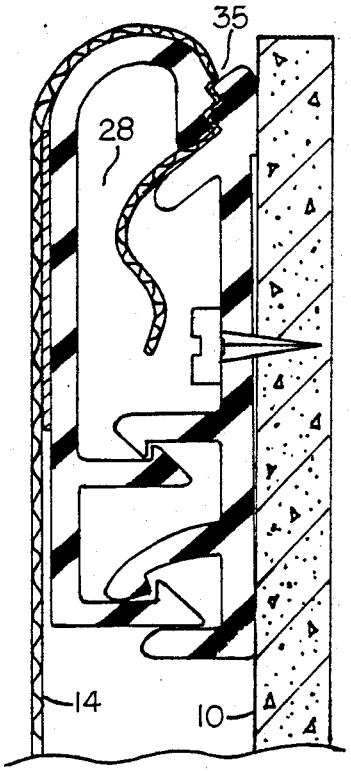
FIG. 6 is the same side view as FIG. 5 illustrating the fabric supporting border pieces in their snapped together position.

Referring now to FIG. 5, there is shown a third extruded track 30, in the pre-snapped position, the top longitudinal edge of this third track having a longitudinal curved arm 29 with longitudinal mating grooves 31, the curved arm 29 with mating grooves 31 are positioned in relationship to contact the longitudinal grooves 16 of track 11, this curved arm 29 with mating grooves 31 represent the second half of a second set of working jaws as illustrated in FIG. 6 35. This third track is used to facilitate fabric installation on corners and visible edges.

The existing features of the third track 30, having all of the identical characteristics and functions as track 12 FIG. 3, a male mating barb 24, second longitudinal barb 23, flat longitudinal face 36 and a longitudinally placed two-way adhesive 15.

Figure 7:
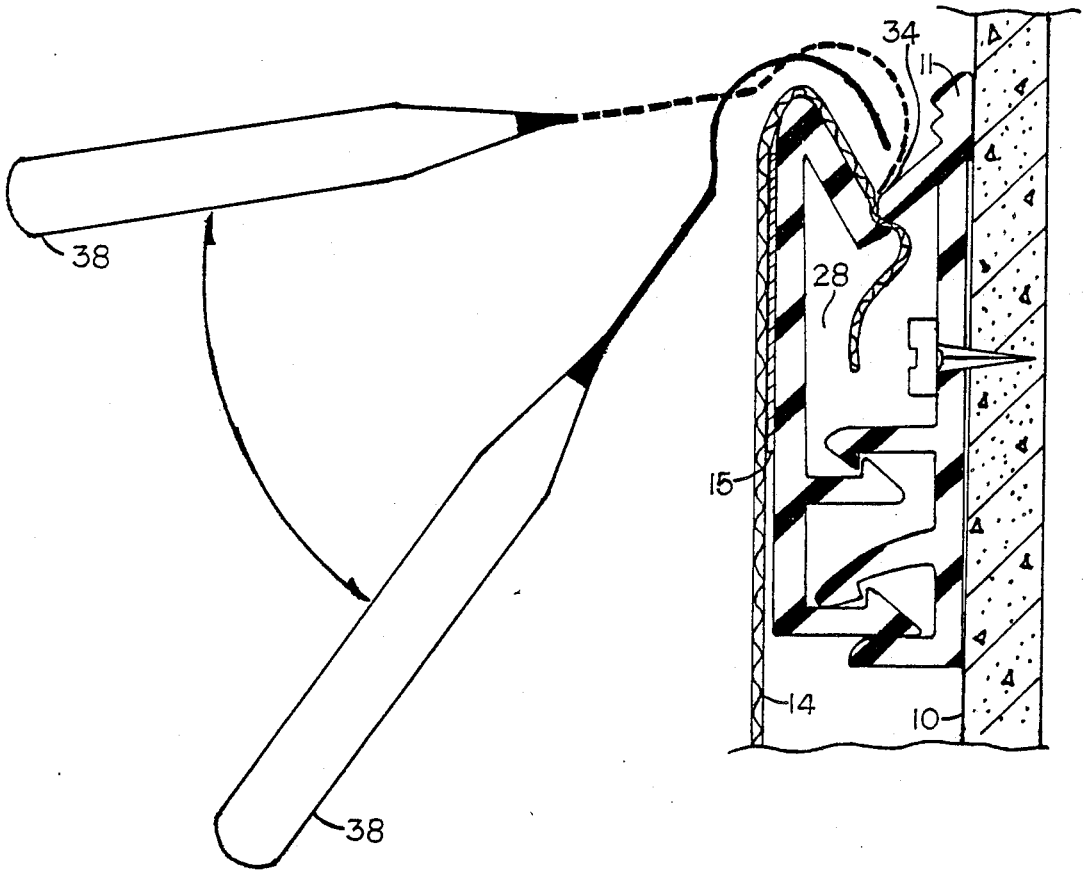
FIG. 7 illustrates the required tool and its operation for tucking fabric into the fabric storage slot.

Referring now to FIG. 7, there is illustrated the tucking tool 38 and the manner in which it is used for tucking excess fabric through the sets of working jaws 34 and FIG. 6 35 into the fabric storage slot 28, resulting in a smooth tight appearance.

Finally, because of the present inventions two piece track assembly and its intermeshing design, the first track 11 FIG. 4 allows for the sliding and conforming ability of the second track 12 FIG. 4 while facilitating each other in the same manner as illustrated in FIG. 4 on extreme curves.

In view of the foregoing, it will be evident that the fabric fastening track assembly of the present invention has increased advantages in the hanging, stretching, and securing of fabrics onto a wall surface, whereby, extreme curvatures, pillars and columns can be easily covered due to the tracks flexibility and ability to facilitate each other on these extreme curves. Furthermore the fabric fastening track assembly of the present invention has additional advantages in that:

it permits for the fastening of the first track to the wall surface inside closest to the point of maximum tension;

it permits for the staggering of seams, whereby the second track will overlap the first track seams and vice versa, increasing overall strength. Due to this overlapping method, alignemtn of second track to first track is automatic;

it allows for the rapid removal of the second or third track from the first track, without the need to unfasten or refasten to the wall surface, whereby reducing the time and materials needed; and it permits for the covering of a wall with windows or doors, without the need to panelize the wall into sections.

Although the description above contains many specificities, these should not be construed as limiting the scope of the invention but by merely providing some of the presently preferred embodiments of this invention.

I claim:

1. A fabric fastening system comprised of intermeshing track assemblies including, in combination:

(a) a first polyvinyl chloride extruded track one flat longitudinal side for contact with a flat wall surface to be covered with fabric, one opposing longitudinal edge of said flat longitudinal side having a set of longitudinal grooves followed downward by a longitudinal angled finger facing away from said wall surface, said longitudinal grooves and said longitudinal angled finger represent a first half of working jaws, a longitudinal barb located downward from said longitudinal angled finger facing outward from said wall surface, said longitudinal barb represents a first half of a positive locking catch, the opposite longitudinal edge of said track having a longitudinal finger facing outward from said wall surface, a slightly curved longitudinal barb located upward from said longitudinal finger, said longitudinal finger and said slightly curved longitudinal barb represent a positive locking slot.

(b) a second polyvinyl chloride extruded track having on one side a flat longitudinal face for direct contact with said fabric, top opposing longitudinal edge of said second extruded track having a downward angled longitudinal arm, a longitudinal concaved notch exits on top of the outermost tip of said downward angled longitudinal arm, said downward angled longitudinal arm and said longitudinal concaved notch represent a second half of a working jaw, a second longitudinal barb facing outward towards said wall surface positioned in relationship to said first longitudinal barb of said first track, said second longitudinal barb represents a second half of a positive locking catch, the opposite longitudinal edge of said second extruded track having a male mating barb facing outward towards said wall surface, whereby after securing said first extruded track with fastening means provided to said wall surface, said second extruded track can be connected by pressing said male mating barb into said positive locking slot, said first and second extruded tracks are pressed together, whereby said first and said second longitudinal barbs intermesh creating said positive locking catch, simultaneously said downward angled longitudinal arm and said longitudinal angled finger connect creating a first set of said working jaws and a fabric storage slot.

(c) a third polyvinyl chloride extruded track having the identical said flat longitudinal face as said second extruded track for contact with said fabric, an identical said second longitudinal barb facing outward towards said wall surface positioned in relationship to said first longitudinal barb, said second longitudinal barb represents a second half of a positive locking catch, an identical said male mating barb is positioned in relationship to said positive locking slot of said first track.

the opposing longitudinal edge of said third extruded track having a longitudinal curved arm with longitudinal mating grooves positioned in relationship as to make contact with said longitudinal grooves of said first track, said longitudinal curved arm with said longitudinal mating grooves and said longitudinal grooves of said first extruded track represent a second set of said working jaws, the said third extruded track facilitates installation options of fabric to corners and edges, fabric is applied to perimeter of said wall surface on top of said longitudinal face of said interlocking track assemblies, excess fabric is allowed for the necessary salvage being tucked into said fabric storage slot, fabric is repeatedly stretched and tucked around said wall perimeter to create a tight flat appearance, said working jaws provide sufficient elasticity to allow for the opening and closing of said working jaws, whereby excess fabric can be tucked into said fabric storage slot, then provide sufficient tension at said working jaws to lock fabric into said fabric storage slot.

2. An assembly according to claim 1, in which the said first, second and third extruded tracks due to their flexibility are capable of conforming and mating to each other on extreme curvatures, said mating on extreme curvatures is facilitated by the flexibility and longitudinal sliding ability of said intermeshed track assemblies.

3. An assembly according to claim 1, including a two way adhesive strip placed longitudinally on said flat longitudinal face of said second and said third extruded track assemblies for the temporary holding of fabric prior to securing excess fabric into the said fabric storage slot.

* * * * *